United States Patent [19]

Ehlmann et al.

[11] Patent Number: 4,972,170

[45] Date of Patent: Nov. 20, 1990

[54] HIGH SPEED FUSE

[75] Inventors: Arlie H. Ehlmann, Barnhard; Ronald E. Mollet, Ellisville; Fred Levko, Chesterfield, all of Mo.

[73] Assignee: Cooper Industries, Inc., Houston, Tex.

[21] Appl. No.: 436,893

[22] Filed: Nov. 15, 1989

Related U.S. Application Data

[63] Continuation-in-part of Ser. No. 344,796, Apr. 24, 1989, and a continuation-in-part of Ser. No. 344,718, Apr. 24, 1989, and a continuation-in-part of Ser. No. 344,719, Apr. 24, 1989, and a continuation-in-part of Ser. No. 344,717, Apr. 24, 1989.

[51] Int. Cl.[5] ..... H01H 85/143; H01H 85/04

[52] U.S. Cl. ..... 337/228; 337/158; 337/248

[58] Field of Search ..... 337/228, 246, 247, 248, 337/252, 253, 254, 251, 231, 232, 236, 276, 205, 158, 159, 160, 161; 74/52.3; 439/741, 870; 219/93

[56] References Cited

U.S. PATENT DOCUMENTS

| | | | |
|---|---|---|---|
| 973,250 | 10/1910 | Barricklow | 337/246 |
| 2,557,793 | 6/1951 | Mucher | 337/233 |
| 2,811,702 | 10/1957 | Narozny | 439/741 |
| 2,914,745 | 11/1959 | Krol et al. | 439/870 |
| 3,118,049 | 1/1964 | Gros et al. . | |
| 3,261,950 | 7/1966 | Kozacka | 337/160 |
| 3,301,978 | 1/1967 | Fister | 337/254 |
| 3,491,322 | 1/1970 | Kozacka . | |
| 3,766,507 | 10/1973 | Jacobs, Jr. . | |
| 4,203,020 | 5/1980 | Armbruster et al. . | |

FOREIGN PATENT DOCUMENTS

| | | | |
|---|---|---|---|
| 1962269 | 12/1969 | Fed. Rep. of Germany . | |
| 499999 | 1/1939 | United Kingdom . | |
| 161244 | 6/1954 | United Kingdom | 337/248 |

*Primary Examiner*—H. Broome

*Attorney, Agent, or Firm*—Donald J. Verplancken; David A. Rose; Ned L. Conley

[57] ABSTRACT

The high speed fuse employs stamped end bell and terminals rather than forged or machined parts. A slot for the terminal is punched through the end bell. The terminal is inserted into the slot in the end bell and staked in position. This insures a strong tight fit without requiring welding or soldering. One end of each terminal has coined ridges to facilitate automatic welding of the fuse link to the terminals. Round balls are used to seal the fill holes for the arc quenching material. Metal pins secure the end bells within the fuse housing but are not electrically connected to the terminals because of the insulative end bells.

24 Claims, 4 Drawing Sheets

HIGH SPEED FUSE

RELATED APPLICATIONS

This is a continuation-in-part of copending applications Ser. No. 07/344,796 filed Apr. 24, 1989; Ser. No. 07/344,718 filed Apr. 24, 1989; Ser. No. 07/344,719 filed Apr. 24, 1989 and Ser. No. 07/344,717 filed Apr. 24, 1989.

BACKGROUND OF THE INVENTION

This invention relates in general to fuses and more particularly to high speed fuses.

High speed fuses have been used for a number of years for the protection or isolation of semiconductor devices such as diodes and thyristors. There is very little safety factor in these semiconductor devices and they can fail quickly when subjected to overcurrents. Therefore, a fuse designed to protect semiconductor devices must open quickly. High speed fuses have very little thermal capacity, and in general open in the order of 0.001 to 0.004 seconds when interrupting short circuits.

Problems exist with high speed fuses currently on the market because these fuses have been developed over time to meet specific applications, resulting in a large number of different fuses made in different sizes and shapes to satisfy the voltage and amperage ranges expected to be encountered. Several hundred different parts and subassemblies for these fuses may be required. Thus, it would be desirable to be able to manufacture fuses having standardized parts to reduce the total number of parts that need to be stocked in order to manufacture a complete line of high speed fuses.

Many applications for high speed fuses require the use of a plurality of fuses usually mounted side by side in close proximity of one another. Many users wish to mount multiple fuses as close together as possible. Prior art high speed fuses have metal end bells which are mechanically and thus electrically connected to the mounting terminals held to the insulating tube with metal pins which are exposed flush with the tube surface and are not sealed. Consequently, when in use in an electrical circuit, the pins are at the same electrical potential as the terminals and end bells. Typically, three phase electrical applications use a fuse in each phase mounted adjacent to each other and as close as possible to conserve space within the equipment. Industrial standards govern minimum spacing between electrically hot parts and dictate the minimum distance between live or "electrically hot" parts through air as a function of stand-off voltage. Since the pins are electrically hot and exposed to the tube surface, this minimum distance is measured between adjacent tube surfaces, as opposed to terminal distances.

Yet another difficulty is encountered in manufacturing high speed fuses in that the end bell must be joined to the terminal for mechanical strength of the fuse package and, in most designs, for the electrical connection between the current carrying fusible elements within the fuse and the mounting terminal. Prior art high speed fuses accomplished this by brazing, welding or soldering the terminal to the end bell or machining the end bell and terminal from a solid piece of metal or by pressing the metal pins through the tube and end bell and into the mounting terminal. All these techniques are labor intensive.

A further problem is encountered with end bells in that these circular pieces of metal are most often forged or machined from rod stock and coined, drilled, and sized. This again requires extra time and additional labor and is thus more expensive.

Yet another manufacturing problem is encountered in making high speed fuses. These fuses, in general, are filled with sand or other arc quenching materials. This material is added through a hole in the end bell after the end bell is assembled to the fuse tube. Various methods of plugging the hole have been used, but all suffer from various limitations. For example, costly knurled plugs are used which require excessive pressure to insert the plug into the hole in the end bell. A more economical means to close the sand hole is required.

SUMMARY OF THE INVENTION

The present invention employs stamped end bells and terminals rather than forged or machined parts. A slot for the terminal is punched through the end bell. The terminal is inserted into the slot in the end bell and staked in position. This insures a strong tight fit without requiring welding or soldering. One end of each terminal has coined ridges to facilitate automatic welding of the fuse link to the terminals. Round balls are used to seal the fill holes for the arc quenching material. Alternatively, the end bells may be molded of plastic. Metal pins secure the end bells within the fuse housing but are not electrically connected to the terminals because of the insulative end bells.

DETAILED DESCRIPTION OF THE INVENTION

Figure 1A:
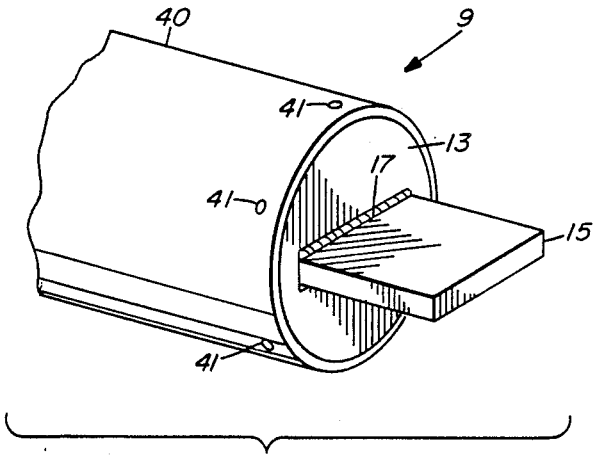
FIG. 1A (PRIOR ART)
FIG. 1A shows a perspective view partially cut away of a prior art fuse.
Figure 9:
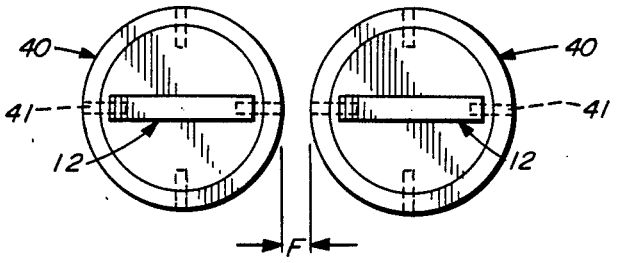
FIG. 9 shows the cross section of two adjacent fuses illustrating positioning distance.
Figure 7:
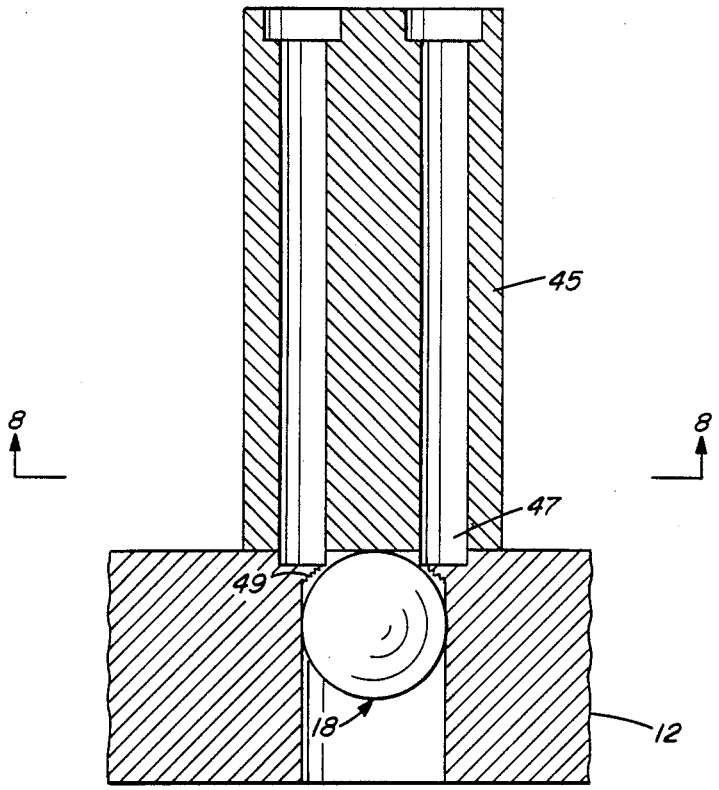
FIG. 7 is a partial cross-sectional view of the installation of the ball in a sand hole as shown in FIG. 5.
Figure 8:
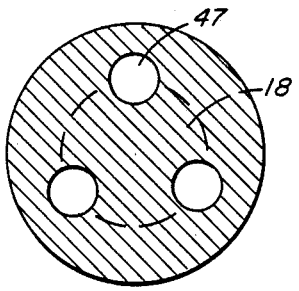
FIG. 8 is a cross-sectional view along the lines 8—8 in FIG. 7.

FIG. 1A shows a prior art high speed fuse 9. Metal end bells 13 with terminals 15 are housed within the ends of an insulating tube 40. It is seen that the terminal 15 is welded or brazed at 17 onto the metal end bell 13. Thus the end bell 13 is electrically hot when the fuse is mounted in an electrically energized circuit. The end bell is held in place in insulating tube 40 by metal pins 41 which are also at the same voltage level as the end bell 13. Thus, as shown in FIG. 9, the minimum distance "F" that prior art high speed fuses can be placed adjacent to each other, as dictated by industrial standards, is governed by the distance between the electrically hot pins 41 of adjacent fuses.

Figure 1B:
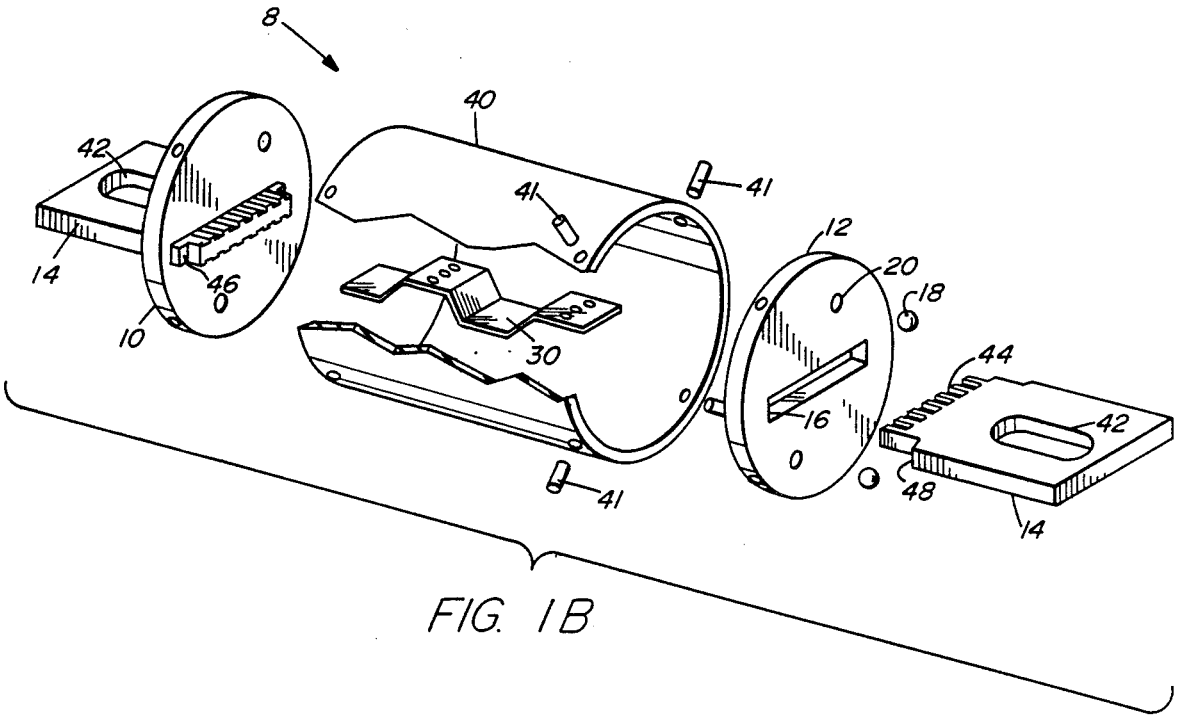
FIG. 1B shows a perceptive view partially in section and exploded of a fuse according to the present invention.
Figure 4:
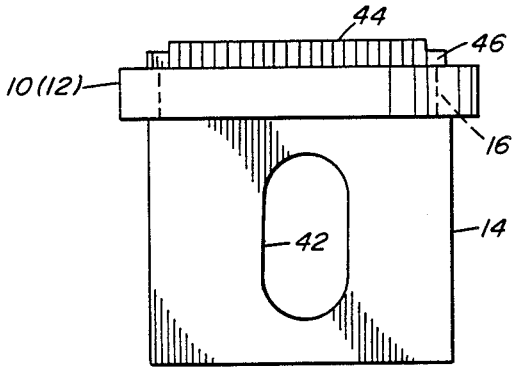
FIG. 4 shows a complete end bell assembly.
Figure 5:
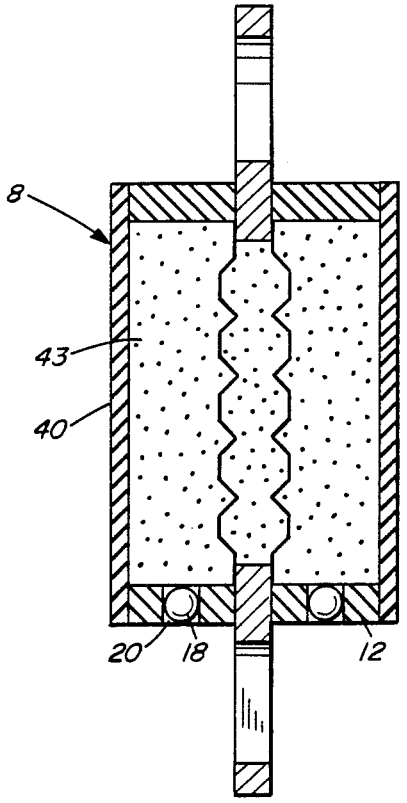
FIG. 5 shows a side cross-sectional view of the assembled fuse of FIG. 1B.
Figure 6:
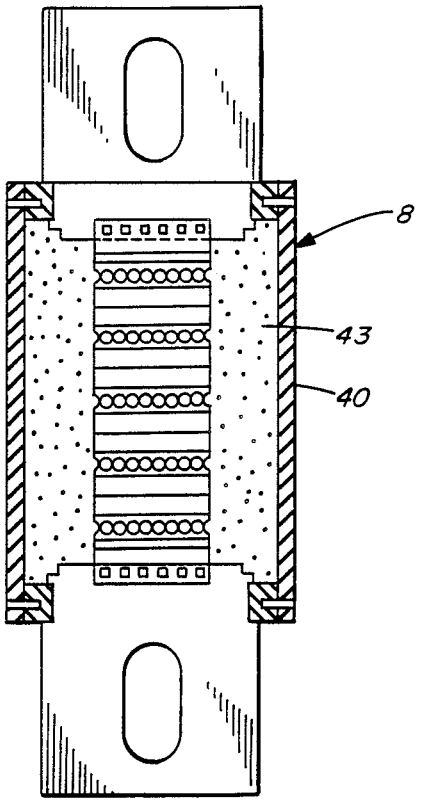
FIG. 6 is a top cross-sectional view of the fuse shown in FIG. 1B.

In the fuse according to the present invention shown in FIGS. 1B, 5 and 6 and referred to generally by numeral 8, an end bell assembly of an end bell 12 and terminal 14 are adapted to be received in each end of insulating housing or tube 40. The end bell 12 and terminal 14 are stamped from a piece of material and a slot 16 is punched in the end bell 12. The terminal 14 is inserted into the slot 16 until shoulders 48 engage the end bell 12. The terminal 14 is then staked at 46 or coined or mechanically upset in position as shown in FIG. 4 to attach terminal 14 to end bell 12. Thus the terminal and the end bell are joined without brazing, welding or soldering, and without complicated mechanical assembly using additional components. It is more cost efficient to produce the parts by stamping rather than by forging. Stamping provides a scrap reduction over making the parts from forging and also allows the selection of appropriate materials for the end bell 12 and terminal 14 which can be of dissimilar materials such as plastic and metal.

Figure 2:
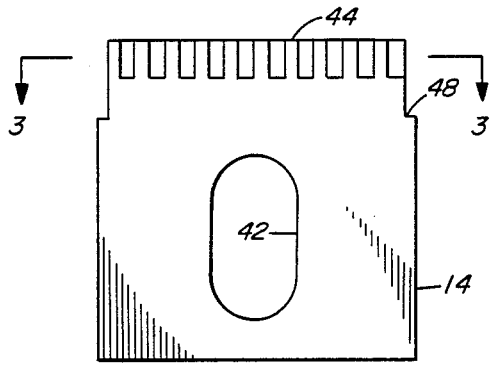
FIG. 2 shows a top view of a terminal of the fuse shown in FIG. 1.
Figure 3:
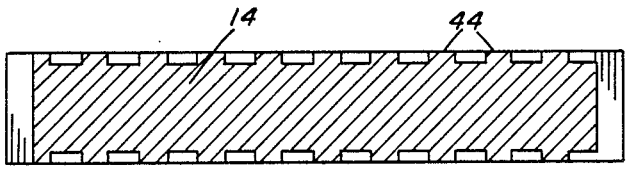
FIG. 3 shows a front view along the lines 3—3 of the terminal shown in FIG. 2.

As shown in FIGS. 2 and 3, a series of small rectangular cross-sectioned ridges, weld pads or projections 44 are embossed on the inner end of terminal 14 during fabrication for welding terminal 14 to one end of a fuse element 30, preferably by resistance welding. These weld projections 44 may be coined or machined into terminal 14. The height of each of weld projections 44 is the same over the entire weld area. The number of projections 44 is determined by the width of terminal 14. The size and shape of the pads may vary from terminal to terminal depending upon the size of fuse element 30 and end bell 12. A saw tooth pattern may also be used in some applications. The pitch and depth of the saw tooth will vary with link thickness.

An advantage to using weld projections 44 on the terminal 14 is that it improves the welding of the fusible element 30 to the terminal 14. Weld projections 44 provide consistent weld quality and welded surface area resulting in consistent heat transfer and electrical conductivity through the welded joint between the fusible element 30 and the terminal 14 of fuse 8. This results in more reliable fuse performance and reduction in costs because all welds can be made simultaneously. This procedure also reduces maintenance of the weld electrodes because both electrodes are flat blades as compared to small pointed electrodes. This type of construction is also very useful for automating welding and results in a more consistent weld than that afforded by prior art spot welding techniques. Direct labor is reduced because multiple welds can be made with each electrode closure. Thus, the time required to weld the strip to the terminal is reduced, the consistency of the weld area is improved, and the electrical conductivity and heat transfer from terminal strip to fuse element is consistent.

The fuse element 30 is preferably of a standardized planar design using an accordion shape which allows for the use of an element having a substantially longer overall effective length than can be achieved with a straight through element as in most prior art high speed fuses. The increase in effective length enhances the ability of the fuse to clear lower level overcurrent situations, especially on DC circuits. As shown in FIGS. 5 and 6, a fuse element 30 may be welded to both sides of terminals 14 to provide a multiple element fuse.

Referring now to FIG. 9, since the terminal 14 projects through the front face and back face of the end bell 12, the fusible element 30 may be electrically connected directly to the terminal 14. Thus, the end bell 12 does not need to be made of electrically conducting material, and may be made of plastic or other non-electrically conductive materials. End bells 12 of insulating material, such as plastic, are less expensive than metal end bells and can be molded instead of machined allowing for the use of more intricate shapes when necessary. The insulating end bells 12 not only serve their normal function of closing off the ends of the insulating tube 40 of fuse 8 and provide the required structural integrity to the fuse package, their use results in the metal pins 41, which secure the end bell 12 within the tube 40, being insulated from the electrical circuit passing through terminal 14 and fusible element 30.

An advantage of using plastic or other non-electrically conductive material for the end bell 12 is that pins 41, designed to project through the insulating tube 40 into the end bell 12, are not energized since the end bell is not electrically conductive. Since holding pins 41 are not "electrically hot" when mounted side by side, fuses can be positioned closer together thus conserving panel board space in equipment. In the prior art fuse where the metal pin is electrically hot, the adjacent fuses cannot be mounted side by side in close proximity more than the distance "F" shown in FIG. 9. The separation between the fuses is governed by the distance between the terminals which are electrically hot. However, when mounted in an electrical circuit, high speed fuses manufactured according to the present invention may be positioned closer to one another since the minimum distance "F" is measured between the electrically hot terminals 14 and not the pins 41 as shown in FIG. 9.

As the fuses are assembled, a first terminal is joined to a first end bell, a second terminal is joined to a second end bell, and the fusible element 30 is welded between the two terminals. Because of the weld projections 44 on the terminal 14, the welding of the fusible element may be done by projection welding.

Referring now to FIGS. 5–8, the assembly of the end bell assemblies welded to the ends of the fusible element 30 is slipped into the insulating tube 40 and the end bells are held in position within tube 40 by pins 41 which are inserted into aligned apertures in tube 40 and end bells 12. Aligned apertures are placed in the end bells 12 and tube 40 by drilling just prior to insertion of pins 41. An arc quenching material 43, shown in FIGS. 5 and 6, typically special sand, is poured into sand holes 20 in the end bell 12. After the high speed fuse 8 is filled with sand, the holes 20 are closed using a solid spherical ball 18. These round balls 18 may be steel or other material and are slightly larger than the hole 20 in the end bell 12. The ball 18 is prevented from misalignment because it is guided by its own natural radius into the hole 20. The balls 18 are thus self-centering and are held in place by frictional force. Alternately, particularly where end bells 12 are metal, such as brass, the sand hole 20 may be coined after insertion of the ball 18 to hold the ball in. The balls 18 are forced or pressed into the end bell 12 by an insertion tool 45. The ball 18 is trapped between three small pins 47 which displace the metal 49 of the metal end bell 12 over the ball 18 while the final insertion is being accomplished. The flat bottom of the insertion tool 45 provides automatic insertion depth. Over insertion is prevented by the design of the insertion tool 45. Using balls 18 has several advantages. The hardened steel ball 18 provides a low cost, self-aligning, easily inserted means of plugging the fill hole 20 in the end bell 12 of a fuse 8. The steel ball 18 requires less force to insert and tends to be self-locking. This is significantly easier than prior art processes which often used pins, hollow closed-end cylinders, or screws to seal the holes.

It is seen that high speed fuses manufactured according to the present invention are easier to construct, require less labor and are consequently less expensive to manufacture and, in one embodiment, can be used closer together, when mounted adjacent to one another, with reduced danger of shorting from fuse to fuse.

We claim:

1. A fuse comprising;
a first end bell having a first terminal;
a second end bell having a second terminal;
a fuse element electrically connecting said first and second terminals;
a housing receiving said end bells, terminals and fuse element;
said first end bell having at least one aperture with a circular cross-section therethrough;
a spherical solid ball having a cross-section greater than said cross-section of said aperture for insertion into said aperture, said ball self-centering as said ball is inserted into said aperture and frictionally held within said aperture;
said housing having a plurality of circumferentially spaced holes in each end of said housing;
said first and second end bells having a plurality of bores circumferentially spaced around the periphery thereof adapted for alignment with said holes;
said first and second end bells being made of a non-electrically conductive material; and
metal pins received within said aligned holes and bores for securing said end bells within said housing, said pins in non-electrical contact with said terminals and fuse element.

2. A fuse comprising:
a first end bell having an opening therethrough;
a first terminal having an inner end extending through said opening and projecting from said first end bell;
said inner end having weld projections;
a second end bell having a second terminal;
a fuse element having one end welded to said weld projections on said first terminal and another end welded to said second terminal;
a housing receiving said end bells, terminals and fuse element;
said first end bell having at least one aperture with a circular cross-section therethrough; and
a spherical solid ball having a cross-section greater than said cross-section of said aperture for insertion into said aperture, said ball self-centering as said ball is inserted into said aperture and frictionally held within said aperture.

3. A fuse comprising:
a first end bell having an opening therethrough;
a first terminal having an inner end extending through said opening and projecting from said first end bell;
said inner end being staked to attach said first terminal to said first end bell;
a second end bell having a second terminal; a fuse element electrically connecting said first and second terminals;
a housing receiving said end bells, terminals and fuse element;
said first end bell having at least one aperture with a circular cross-section therethrough; and
a spherical solid ball having a cross-section greater than said cross-section of said aperture for insertion into said aperture, said ball self-centering as said ball is inserted into said aperture and frictionally held within said aperture.

4. A fuse comprising:
a first end bell having an opening therethrough;
a first terminal having an inner end extending through said opening and projecting from said first end bell;
said inner end having weld projections;
a second end bell having a second terminal;
a fuse element having one end welded to said weld projections on said first terminal and another end welded to said second terminal;
a housing receiving said end bells, terminals, and fuse element;
said housing having a plurality of circumferentially spaced holes in each end of said housing;
said first and second end bells having a plurality of bores circumferentially spaced around the periphery thereof adapted for alignment with said holes;
said first and second end bells being made of a non-electrically conductive material; and
metal pins received within said aligned holes and bores for securing said end bells within said housing, said pins in non-electrical contact with said terminals and fuse element.

5. A fuse comprising:
a first end bell having an opening therethrough;
a first terminal having an inner end extending through said opening and projecting from said first end bell;
said inner end being staked to attach said first terminal to said first end bell;
a second end bell having a second terminal;
a fuse element electrically connecting said first and second terminals;
a housing receiving said end bells, terminals and fuse element;
said housing having a plurality of circumferentially spaced holes in each end of said housing;
said first and second end bells having a plurality of bores circumferentially spaced around the periphery thereof adapted for alignment with said holes;
said first and second end bells being made of a non-electrically conductive material; and
metal pins received within said aligned holes and bores for securing said end bells within said housing, said pins in non-electrical contact with said terminals and fuse element.

6. A fuse comprising:
a first end bell having an opening therethrough;
a first terminal having an inner end extending through said opening and projecting from said first end bell;
said inner end being staked to attach said first terminal to said first end bell;
said inner end having weld projections;
a second end bell having a second terminal;
a fuse element having one end welded to said weld projections on said first terminal and another end welded to said second terminal; and
a housing receiving said end bells, terminals, and fuse element.

7. A fuse comprising:
a first end bell having an opening therethrough;

a first terminal having an inner end extending through said opening and projecting from said first end bell;

said inner end being staked to attach said first terminal to said first end bell and having weld projections;

a second end bell having a second terminal;

a fuse element having one end welded to said weld projections on said first terminal and another end welded to said second terminal;

a housing receiving said end bells, terminals and fuse elements;

said first end bell having at least one aperture with a circular cross-section therethrough;

a spherical solid ball having a cross-section greater than said cross-section of said aperture for insertion into said aperture, said ball self-centering as said ball is inserted into said aperture and frictionally held within said aperture;

said housing having a plurality of circumferentially spaced holes in each end of said housing;

said first and second end bells having a plurality of bores circumferentially spaced around the periphery thereof adapted for alignment with said holes;

said first and second end bells being made of a non-electrically conductive material; and metal pins received within said aligned holes and bores for securing said end bells within said housing, said pins in non-electrical contact with said terminals and fuse element.

8. A fuse as in claim 1, 2 or 3 wherein said first end bell is coined around said aperture after said ball is inserted into said aperture.

9. A fuse as in claim 2, 4, 6 or 7 wherein said weld projections are parallel with the longitudinal axes of said terminals and said fuse element.

10. A fuse as in claims 2, 4, 6 or 7 wherein said weld projections have a longitudinal length substantially the distance said inner end of said first terminal projects from said opening.

11. A fuse as in claims 2, 4, 6 or 7 wherein said weld projections are disposed on both sides of said inner end of said first terminal.

12. A fuse as in claims 2, 4, 6 or 7 wherein said weld projections are alternating ridges and grooves around said inner end with said grooves and said ridges being in alignment on each side of said inner end.

13. A fuse as in claims 2, 4, 6 or 7 wherein said weld projections are alternating ridges and grooves.

14. A fuse as in claims 2, 4, 6 or 7 wherein said weld projections and alternating ridges and grooves and said grooves have a depth less than one-half the thickness of said first terminal.

15. A fuse as in claims 2, 4, 6 or 7 wherein said weld projections are alternating ridges and grooves and said ridges are rectangular in cross-section forming a flat projecting surface.

16. A fuse as in claims 2, 4, 6 or 7 wherein said well projections are alternating ridges and grooves and said grooves have a bottom perpendicular wall.

17. The fuse as in claim 15, wherein said end bells and terminals are stampings.

18. A fuse as in claim 1 wherein said first end bell has a rectangular slot therethrough for receiving said first terminal, said terminal being rectangular in cross section and having a portion thereof projecting through said slot into the interior of the fuse, said projecting portion of said terminal is staked to said first end bell to secure said terminal to said end bell.

19. A fuse as in claim 18 wherein said projecting portion includes a reduced width portion forming a shoulder, said projecting portion passing through said slot until said first end bell engages said shoulder, said projecting portion having a weld projection on its terminal end, said weld projection being staked to said end bell and adapted for connection to said fuse element.

20. A fuse as in claim 18 wherein said staking is the sole connection between said first terminal and said first end bell.

21. A fuse as in claims 1, 2, 3, 4, 5, 6, or 7 wherein said fuse element is an elongated planar element having an accordion shaped cross section.

22. A fuse as in claims 2, 4, 6 or 7 wherein said weld projections are coined onto said first terminal.

23. A fuse as in claims 4, 5, or 6 wherein said first end bell has at least one aperture with a circular cross-section therethrough; and a spherical solid ball has a cross-section greater than said cross-section of said aperture for insertion into said aperture, said ball self-centering as said ball is inserted into said aperture and frictionally held within said aperture.

24. A fuse as in claims 2, 3, or 6 wherein said first and second end bells having a plurality of bores circumferentially spaced around the periphery thereof adapted for alignment with said holes; said first and second end bells are made of a non-electrically conductive material; and metal pins are received within said aligned holes and bores for securing said end bells within said housing, said pins being in non-electrical contact with said terminals and fuse element.

* * * * *